United States Patent [19]

McCaskill

[11] 4,284,259

[45] Aug. 18, 1981

[54] REINFORCED PULL SHEET

[75] Inventor: Matt L. McCaskill, Orlando, Fla.

[73] Assignee: Alton Box Board Company, Alton, Ill.

[21] Appl. No.: 17,167

[22] Filed: Mar. 5, 1979

[51] Int. Cl.[3] ..... B32B 3/28; A47B 91/00

[52] U.S. Cl. ..... 248/346; 108/51.3; 428/121; 428/220; 428/186; 428/191; 428/192

[58] Field of Search ..... 428/186, 191, 192, 121; 108/51.3, 51.1; 248/346; 156/210

[56] References Cited

U.S. PATENT DOCUMENTS

| | | | |
|---|---|---|---|
| 2,913,206 | 11/1959 | Paris | 108/51.1 |
| 4,085,847 | 4/1978 | Jacalone | 108/51.3 |
| 4,091,923 | 5/1978 | Collins | 108/51.3 |

FOREIGN PATENT DOCUMENTS

| | | | |
|---|---|---|---|
| 2802330 | 7/1978 | Fed. Rep. of Germany | 108/51.3 |
| 214797 | 5/1924 | United Kingdom | 156/210 |
| 650703 | 2/1951 | United Kingdom | 108/51.3 |
| 1146034 | 3/1969 | United Kingdom | 108/51.3 |

*Primary Examiner*—Paul J. Thibodeau
*Attorney, Agent, or Firm*—Paul M. Denk

[57] ABSTRACT

In a pull sheet for use in conjunction with a fork lift truck, or the like, such sheet being generally formed of corrugated board, and more specifically being constructed as double back liner, and there are included a plurality of reinforcing tapes integrally within the construction of the corrugated board, generally being fabricated of paper so as to be capable of recycling with the pull sheet after its terminal usage.

2 Claims, 6 Drawing Figures

REINFORCED PULL SHEET

BACKGROUND OF THE INVENTION

This invention relates generally to slip or pull sheets, and specifically pertains to a reinforced pull sheet that incorporates structural tapes at strategically internal locations so as to withstand the excessive forces imposed upon it during repeated usage.

Pull sheets have long been utilized in the prior art, generally identified as slip sheets, and these sheets are designed of various types of material, frequently paperboard, and are intended to function as a replacement for the more expensive and cumbersome wood type pallets used for supporting the heavy load of stacked material. These slip sheets are of a size to just accommodate the supported load, and generally have dimensions somewhat equivalent to the dimensions of the fork or plate forming the platform for the forklift truck that is utilized for transferring this load throughout various locations, whether about the plant, or onto a truck or railroad car. The pull sheets generally should withstand the rigors of certain forces, since they are initially grasped by means of the gripper bars of the truck that clamp onto an edge of the slip sheet, and which pull the same and its load onto the truck platens, or forks, but at the same time, after the truck has maneuvered the load to its intended location, the same slip sheet is then pushed off of the truck forks for other disposition.

In many instances, these slip sheets of the prior art have only been capable of single usage, facilitating the transfer of a load from its initial stack to its appointed destination, and since the loads absorbed are frequently excessive, the dock workers normally utilize two such corrugated sheets to sustain a single stacked load. Thus, this doubles the cost for this aspect of hauling packaged materials to and from a plant.

Various reinforcing means have been given some consideration in the prior art, but not for use in conjunction with the pull sheet, and such reinforcing means include fiberglass, plastic, or other type of reinforcing string or tape, generally incorporating the hot melt feature, and which tape is applied either to the surface of the paperboard, or the interior surface of the liner, and fabricated into the board during its corrugation. Such formed board has found usage particularly as a means for forming reinforced cartons or boxes, particularly of the type that may be subjected to loading of rather heavy and bulky materials, and which have a tendency to bulge the sides of the cartons and eventually cause their tearing. It is to be noted, though, the type of tapes or strings heretofor contemplated in the art, for this particular purpose, have always been of the more man-made fiber type, whether as fiberglass, or a polymer, and are not capable of being recycled with the paperboard after its usage. In fact, such man-made fibers within the board has presented a problem and a detriment to those paper companies that make it their business to augment their paper stock through the use of recycleable fibers.

It is, therefore, the principal object of this invention is to provide a pull sheet formed of corrugated board and which includes a reinforcing tape that furnishes sufficient structural strength to the sheet to allow for its individual usage in supporting the conveyance of a load by a forklift truck.

Another object of this invention is to provide a pull sheet incorporating recycleable reinforcing tapes that can be repeatedly used, or recycled, after its deterioration beyond usage.

Another object of this invention is to furnish a pull sheet that incorporates a series of conveniently arranged fold lines that facilitates the truck gripping of the pull sheet and its supported load from a variety of directions during the load transfer.

Yet another object of this invention is to provide designed means within a pull sheet forming a plurality of grippable edges, and which edges can be conveniently folded with respect to each other without any mutual interference due to the intersection of their fold lines.

Still another object of this invention is to provide for integral reinforcement of a pull sheet by arranging reinforcing tapes at the edge and central location where the heaviest tearing forces are most frequently encountered.

These and other objects will become more apparent to those skilled in the art upon reviewing the summary of this invention, and upon undertaking a study of the description of its preferred embodiment, in view of the drawing.

SUMMARY OF THE INVENTION

This invention contemplates the formation of a pull sheet formed of corrugated board, generally double faced board, but also which may be formed of either double or triple wall board, depending upon the load to be encountered during its usage. In the case of the double faced board, or the multi-wall board, a reinforcing tape, having a width sufficient to provide for its reinforcement at strategic locations within the pull sheet, are interposed within the sheet intermediate the web and one of its liners, such being accomplished during the formation of the paper board in a corrugating operation. With the usual pull sheets having dimensions anywhere from three to five feet in width and length, the tapes contemplated for reinforcing such a sheet, in terms of this invention, may be within a vicinity of four to eight inches in width, preferably six inches, with two of the tapes being arranged at opposite edges of the formed sheet and extending its length thereof, while the third tape extends centrally down the length of the said sheet.

Since pull sheets of this type, as the name implies, are furnished as a substitute for the heretofore frequently used pallets, some means must be provided for drawing the pull sheet onto the lift of the forklift truck, and at the same time, to provide for its removal or pushing off of the same, after a relocation of a load. Thus, a fold line is furnished at least along one or more edges of the pull sheet, said line being located a few inches, preferrably around four inches, from the edge of the sheet, and capable of providing for an upbending of the sheet along the length of its location so as to facilitate its grasping by the gripper bar of the truck. And, to further add to the convenience to the usage of this particular invention, another fold line, generally arranged along another side edge of the pull sheet, and a few inches offset therefrom, generally along an edge that is perpendicular to the arrangement of the previously defined edge and fold line, is provided so that as the load laden pull sheet is located, as for example, onto a box car, another form of truck means can conveniently grasp the edge of the pull sheet, at this secondly arranged fold line disposed edge, and remaneuver the pull sheet for further and more precise location, as for example, within the box car. But, as can be understood, since there are generally two, three, or more reinforcing tapes provided within the pull sheet of this invention, providing one of the aforesaid fold lines along the length of the sheet, provides for its arrangement conveniently and entirely within one of the reinforcing tapes of the same. And, locating another or the second fold line along a perpendicular edge thereof, provides a fold line that at least crosses the proximate ends of the two or three other reinforcing tapes provided within the pull sheet, meaning that adequate reinforcement for the gripping edges of the pull sheet is provided so as to prevent them tearing at these locations when further manipulated by the forklift truck.

Generally, the pull sheet of this invention will be formed as double wall board, with the liners being fabricated of 275 pound kraft paper, and the reinforcing strips or tapes, as previously explained, in the preferred embodiment, can be fabricated of 90 pound kraft. Thus, adding the reinforcing tapes as described augments sufficient strength into the pull sheet of this invention, so that it can be used individually, thereby obviating the necessity of the worker to pile one or two sheets of this type, and contrary to the prior art, upon each other before he can be assured that the load to be moved can be sustained by the said sheet.

DESCRIPTION OF THE PREFERRED EMBODIMENT

Figure 1:
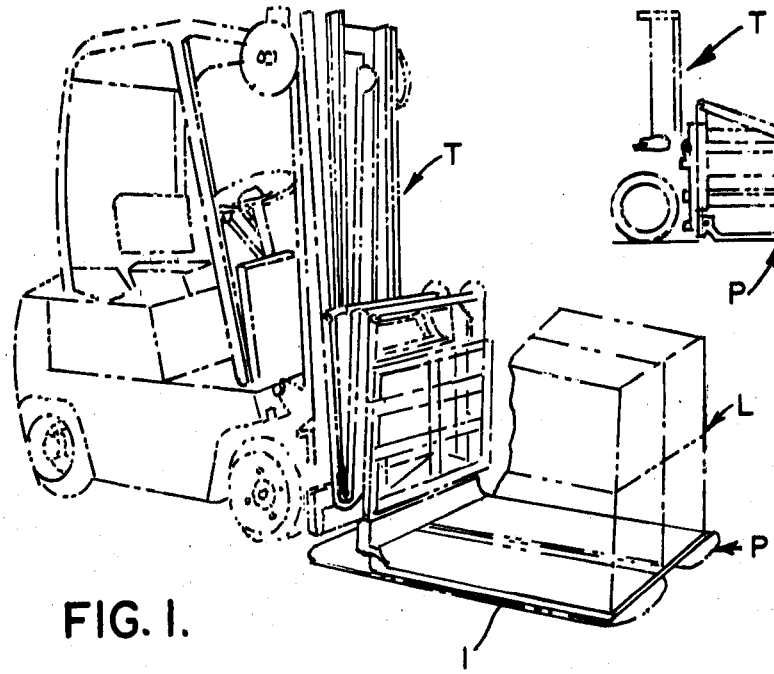
FIG. 1 discloses the load sustaining pull sheet of this invention, as being located upon the platens of a forklift truck.
Figure 2:
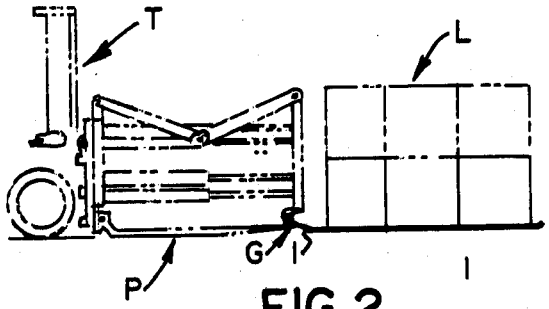
FIG. 2 furnishes a side view of the arrangement of FIG. 1, showing the customary hydraulic linkages of the truck for effecting a pulling of the slip sheet load with respect to the truck platens.

In referring to FIGS. 1 and 2 of the drawing, there is disclosed the pull sheet 1 of this invention supporting a load L on the platens P of the forklift truck T of the type customarily used for transferring and exchanging stacked loads to various locations. And, FIG. 1 discloses the pull sheet of this invention fully positioned onto the platens P of the truck, while FIG. 2 discloses the pull sheet 1 as it is either being prepared for pulling onto the platens P, having one of its edges being grapsed by the gripper G of the truck, or in the alternative, the pull sheet 1 and its supported load may have just been pushed off the platens after having attached its desired situs.

Figure 3:
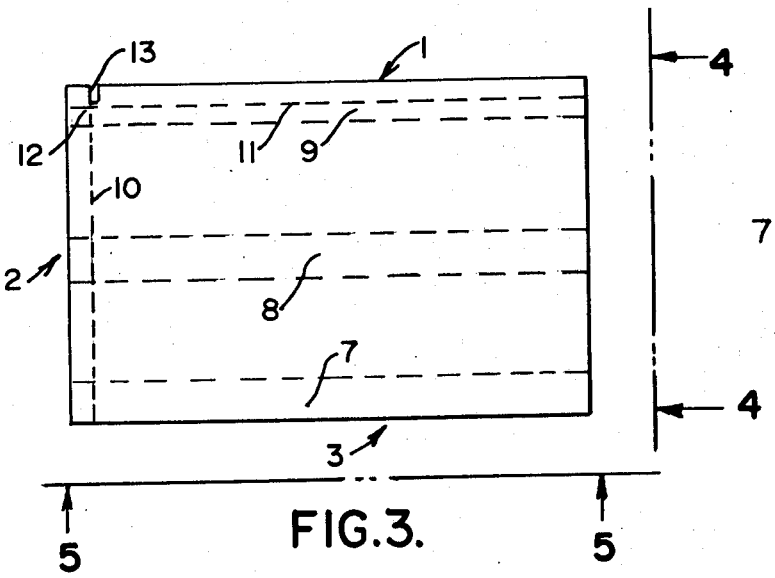
FIG. 3 provides a plan view of the pull sheet of this invention.
Figure 6:
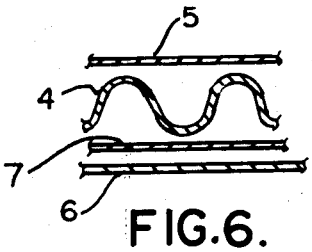
FIG. 6 furnishes an exploded partial side view of the pull sheet taken along the sectional line 6 of FIG. 5.
Figure 5:
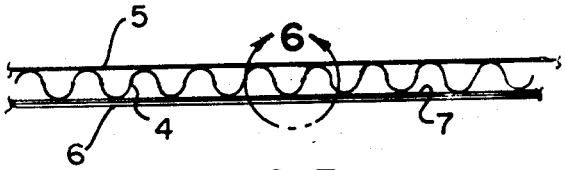
FIG. 5 furnishes a side edge view of the pull sheet of this invention taken along the line 5—5 of FIG. 3.
Figure 4:
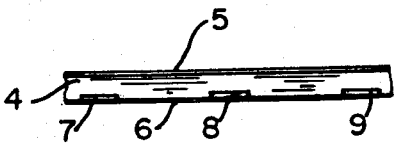
FIG. 4 provides an end view of the pull sheet taken along the lines 4—4 of FIG. 3.

As disclosed in FIG. 3, the pull sheet 1 of this invention includes a width 2 and a length 3 dimensions that are substantially relative to the dimensions of the platens of the forklift truck, and being of a size that can accommodate the type of load this is customarily encountered and used in conjunction with the size of the available forklift truck. As can also be seen from the FIGS. 4 and 5, the pull sheet is fabricated, in this particular instance, as double faced board, having a web of medium 4 being interposed between the liners 5 and 6 of the fabricated board. Obviously, as previously explained, this board could also be formed of double wall or other multi-wall board, as desired. But, in the preferred embodiment, and which has been designed for general usage as a pull sheet in conjunction with a standard size forklift truck, double face board is preferred, and in the particular instance as shown, incorporates a series of reinforcing tapes or strips 7 through 9 internally of the formed board and between one of its liners and web of medium. This is accomplished during the lamination of the board into its corrugated shape, and usually occurs during the corrugating operation when the double back liner is supplied to the web of medium on the corrugator.

As can be more accurately seen in FIG. 3 of the preferred embodiment, at least three of the reinforcing tapes 7 through 9 are provided, but obviously a lesser or greater number of such tapes may be incorporated within the board during its fabrication in order to withstand the type of load expected to be encountered. And, as previously summarized, the reinforcing tapes of this invention are preferably also formed of paper, and in this manner can be recycled with the entire pull sheet when it is returned in its deteriorated condition after prolonged usage.

In order to facilitate the locating or removal of the load bearing pull sheet onto the platens of the truck, a series of fold or score lines are provided proximate the edges of the said sheet. These fold lines, 10 and 11 as shown, are arranged just a few inches inwardly and parallel with the approximate edges of the pull sheet, and are designed to conveniently bend upwardly rather freely in order to facilitate their grasping by the grippers G of the truck, as previously defined. And, as shown in the preferred embodiment, a pair of these fold lines may be arranged along the adjacent sides of the pull sheet, and intersect each other, as at 12, at their juncture near one corner. When this occurs, a slot 13 may be provided extending in alignment with one of the fold lines, the fold line 10 in this instance, and extend from the edge of the sheet up to the point of their intersection, so that each fold line can be independently folded, even simultaneously, witout encountering any interference due to their cross over at the corner as shown. While there are two fold lines shown being provided within the pull sheet construction of the invention, it is just as apparent that such fold lines may be located elsewhere along the edges of the pull sheet, either at their opposite sides thereof, or along all four sides of the same. Thus, when a forklift truck has grasped the edge of the shown pull sheet along the bendable edge formed by means of the fold line 10, after the load bearing pull sheet is located and transferred to a particular position, as for example within a railroad boxcar, another forklift truck may grab the same pull sheet along its edge formed by the fold line 11, and be pulled onto that particular truck's platens, for repositioning of the load laden slip sheet to another precise location within the said boxcar, or elsewhere.

It is believed that sufficient tensile strength is attainable from the tape reinforced pull sheet of this invention, as defined herein, so as to allow for its eventual usage in conjunction with the movement of a substantial load, obviating the need for double or trippling such sheets as now done in the prior art, while at the same time, attaining such reinforcement through the usage of a paper type of strengthening tape that can conveniently be recycled with the entire pull sheet once returned to the paperboard processor after its repeated usage.

Various modifications or variations in the pull or slip sheet design of this invention may occur to those skilled in the art upon reviewing the subject matter of this invention. Any such variations, if within the spirit of this invention, are intended to be encompassed by the scope of any claims to patent protection issuing upon this invention. The detailed definition of this invention as set forth in the specification is done so for illustrative purposes only.

Having thus described the invention, what is claimed and desired to be secured by Letters Patent is:

1. A pull sheet for use in aiding in the application or removal of a load on a forklift truck, and for transferring said load laden pull sheet in a multitude of directions after it has been loaded, comprising, said sheet being formed of at least as a double faced corrugated paperboard, said paperboard having a web of medium being interposed between a pair of liners, a reinforcement means for the sheet, said reinforcement means comprising a paper tape of load sustaining material and being located between the medium web and one of the liners in the said paperboard construction, said sheet including three such parallel and spacedly arranged paper tapes as reinforcement, each paper tape being approximately four to eight inches in width and extending the length of said pull sheet, one of said paper tape being aligned approximately with each side edge of the pull sheet, and the third tape extending approximately centrally along the length of said pull sheet, a first fold line formed on the pull sheet and arranged parallel to and a short distance from one edge of the said sheet to facilitate its gripping by the said truck, a second fold line provided upon the pull sheet and arranged parallel to and a short distance from another edge of the said sheet, wherein said first and second fold lines are approximately perpendicularly arranged with respect to each longitudinal other and intersect within their arrangement within the pull sheet structure, a slot formed aligned along one fold line from an edge of the pull sheet and up to the location of intersection with the other fold line to facilitate the independent bending of each fold line without interference from the other said fold line, at least one of said fold lines being provided along the length of a tape, and the other of said fold lines extending across said reinforcing tapes, and said pull sheet having dimensions to provide for its accommodation onto the fork lift of a truck, with the width and length dimensions of said pull sheet approximating respectively three to five feet.

2. The invention of claim 1 and wherein said paper tape is recycleable with the corrugated paper board pull sheet.

* * * * *

UNITED STATES PATENT AND TRADEMARK OFFICE

CERTIFICATE OF CORRECTION

PATENT NO. : 4,284,259
DATED : August 18, 1981
INVENTOR(S) : Matt L. McCaskill

It is certified that error appears in the above—identified patent and that said Letters Patent is hereby corrected as shown below:

Column 6, line 3, after "each" insert ---longitudinal---.

Column 6, line 13, delete [longitudinal].

Signed and Sealed this

*Twenty-seventh* Day of *October 1981*

[SEAL]

*Attest:*

GERALD J. MOSSINGHOFF

*Attesting Officer*

*Commissioner of Patents and Trademarks*